US006095409A

United States Patent [19]

Tsai

[11] Patent Number: 6,095,409

[45] Date of Patent: Aug. 1, 2000

[54] CARTON PACKAGING

[75] Inventor: Jung-Tang Tsai, Taoyuan, Taiwan

[73] Assignee: Asustek Computer Inc., Taipei, Taiwan

[21] Appl. No.: 09/377,785

[22] Filed: Aug. 20, 1999

[30] Foreign Application Priority Data

Feb. 12, 1998 [TW] Taiwan ..... 87220034
Feb. 12, 1998 [TW] Taiwan ..... 87220036

[51] Int. Cl.[7] ..... B65D 5/42

[52] U.S. Cl. ..... 229/125.37; 229/125.38; 229/199

[58] Field of Search ..... 229/125.37, 125.38, 229/125.39, 199; 206/386

[56] References Cited

U.S. PATENT DOCUMENTS 2,180,104 11/1939 De Marco, Jr. ..... 229/125.38
2,967,612 1/1961 Baumer ..... 206/386
3,128,811 4/1964 Higgins ..... 229/199
3,281,049 10/1966 Avitable et al. ..... 229/125.38
3,913,827 10/1975 Bruckner et al. ..... 229/125.38
5,035,323 7/1991 Daniels et al. ..... 206/386

FOREIGN PATENT DOCUMENTS 1349416 12/1963 France ..... 229/125.38

*Primary Examiner*—Gary E. Elkins
*Attorney, Agent, or Firm*—Majestic, Parsons, Siebert & Hsue P.C.

[57] ABSTRACT

A carton packaging is provided. The carton defines a first direction and a second direction. The first direction of the carton is wrapped up by a first P.P. tape and the second direction of the carton is wrapped up by a second P.P. tape. The first P.P. tape intersects with the second P.P. tape at overlapping portions. The first P.P. tape is bonded to the second P.P. tape at the overlapping portions by an ultrasonic wave heating procedure to prevent the detachment of the first P.P. tape from the second P.P. tape without leaving destructive marks.

2 Claims, 2 Drawing Sheets

4

CARTON PACKAGING

FIELD OF INVENTION

The present invention relates to a package structure and, in particular, to a carton packaging.

BACKGROUND OF INVENTION

To deliver an article effectively and safely, smaller articles are usually disposed within a carton, which is sealed afterwards by transparent tape before shipping. To meet a more stringent requirement, polypropylene (P.P.) tapes are employed to pack the carton instead of the transparent tapes used by the conventional approach.

As shown in FIG. 1, the P.P. tape 10 along the length-wise direction of the carton is used to wrap up the carton in its length-wise direction and therefore packs the carton in this direction. Similarly, the P.P. tape 12 along the width-wise direction of the carton is used to wrap up the carton in its width-wise direction and therefore pack the carton in this direction. The ends of the P.P. tape 10 are bonded to each other by a heat melting procedure. Similarly, the ends of the P.P. tape 12 are bonded to each other by a heat melting procedure.

However, the respective intersection portions of the P.P. tapes 10, 12 are not bonded together in accordance with the conventional approach. As a result, one may easily slide off the P.P. tape 10 or 12 from one side of the carton along the arrows shown in FIG. 1, without leaving any destructive marks over the P.P. tapes, and steal the valuable goods in the carton. The thief may then restore the P.P. tapes 10, 12 to their respective initial positions to make the carton look like a well-wrapped carton while the valuable goods inside no longer exist. As the carton recipient discovers the disappearance of goods within the carton during unpacking of the carton, the police or the insurance company can not determine the actual location at which the theft of goods happened. This is due to the fact that no destructive marks are left on the P.P. tapes 10, 12 during the theft.

To solve the aforementioned problem, the present invention provides a packaging which allows the immediate signaling of a theft incident. The thief must destroy the P.P. tapes of the packaging to fully open the carton packed by the invention. Therefore, once the P.P. tapes are found to be destroyed, the location of the theft incidence can be determined and reported immediately.

SUMMARY OF INVENTION

In essence, the packaging of the invention includes a bonding operation of the overlapping portions of the intersecting P.P. tapes by an ultrasonic wave heating procedure. Unless the bonded overlapping portions of the P.P. tapes are torn away, the carton can not be opened.

The carton defines a first direction and a second direction. The first direction of the carton is wrapped up by a first P.P. tape and the second direction of the carton is wrapped up by a second P.P. tape. The first P.P. tape intersects with the second P.P. tape at respective overlapping portions.

The carton packaging is characterized in that the first P.P. tape is bonded to the second P.P. tape at the overlapping portion by an ultrasonic wave heating procedure to prevent the detachment of the first P.P. tape from the second P.P. tape without leaving destructive marks.

DESCRIPTIONS OF DRAWINGS

DESCRIPTIONS OF PREFERRED EMBODIMENT

Figure 1:
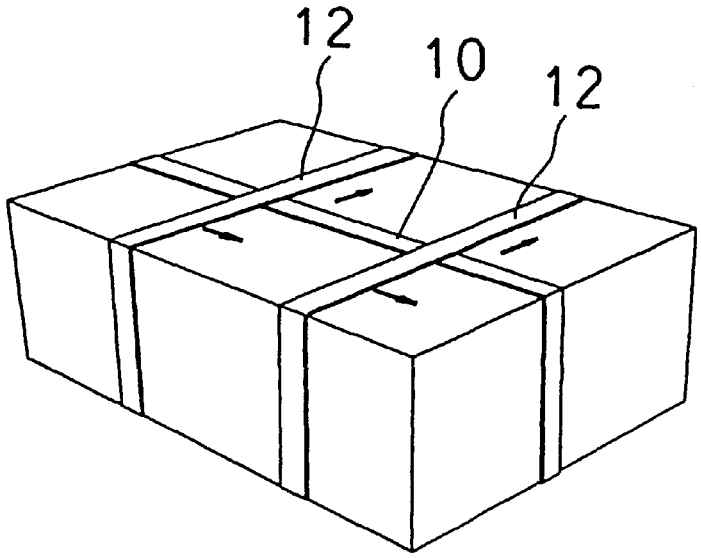
FIG. 1 shows a carton wrapped by P.P. tapes in accordance with the prior art.
Figure 2:
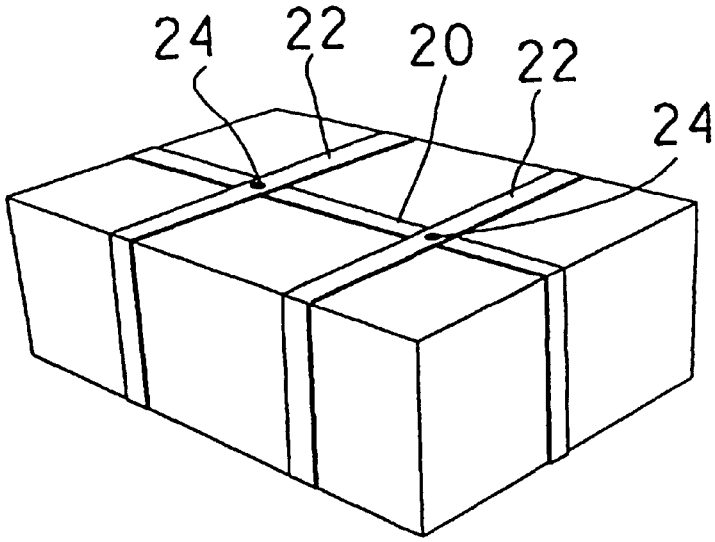
FIG. 2 shows the carton packed by P.P. tapes in accordance with the invention.
Figure 3:
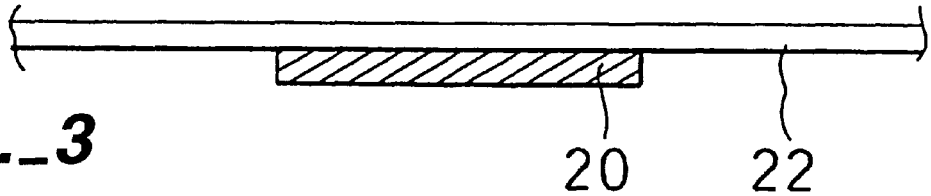
FIG. 3 shows the bonding relationship between the P.P. tapes 20 and 22 in a cross sectional view.

As shown in FIG. 2, the P.P. tape 20 is the tape wrapping the lengthwise direction of the carton while the P.P. tape 22 is the tape wrapping the width-wise direction of the carton. In accordance with the present invention, the respective overlapping portions of the first P.P. tape 20 and second P.P tape 22 are bonded to each other by an ultrasonic wave heating procedure. As the bonding procedure is complete, their relative relationship is shown in FIG. 3.

It may be understood that the overlapping portions of the first and second P.P. tapes 20, 22 are bonded together, which does not allow the relative movement between them. Therefore, unless the bonding structure as shown in FIG. 3 is demolished, leaving marks of destruction, one can not open the carton and steal the goods inside.

When the strength of the P.P. tape is large enough, one may implement tiny teeth structure over the surface of the melting head, which creates corresponding tooth traces 24 over the surface of the P.P. tape 22 after the heat bonding operation. The bonding apparatus will be recited below. However, if the strength of the P.P. tape is not enough, no tooth trace is provided over the surface of the P.P. tape.

Figure 4:
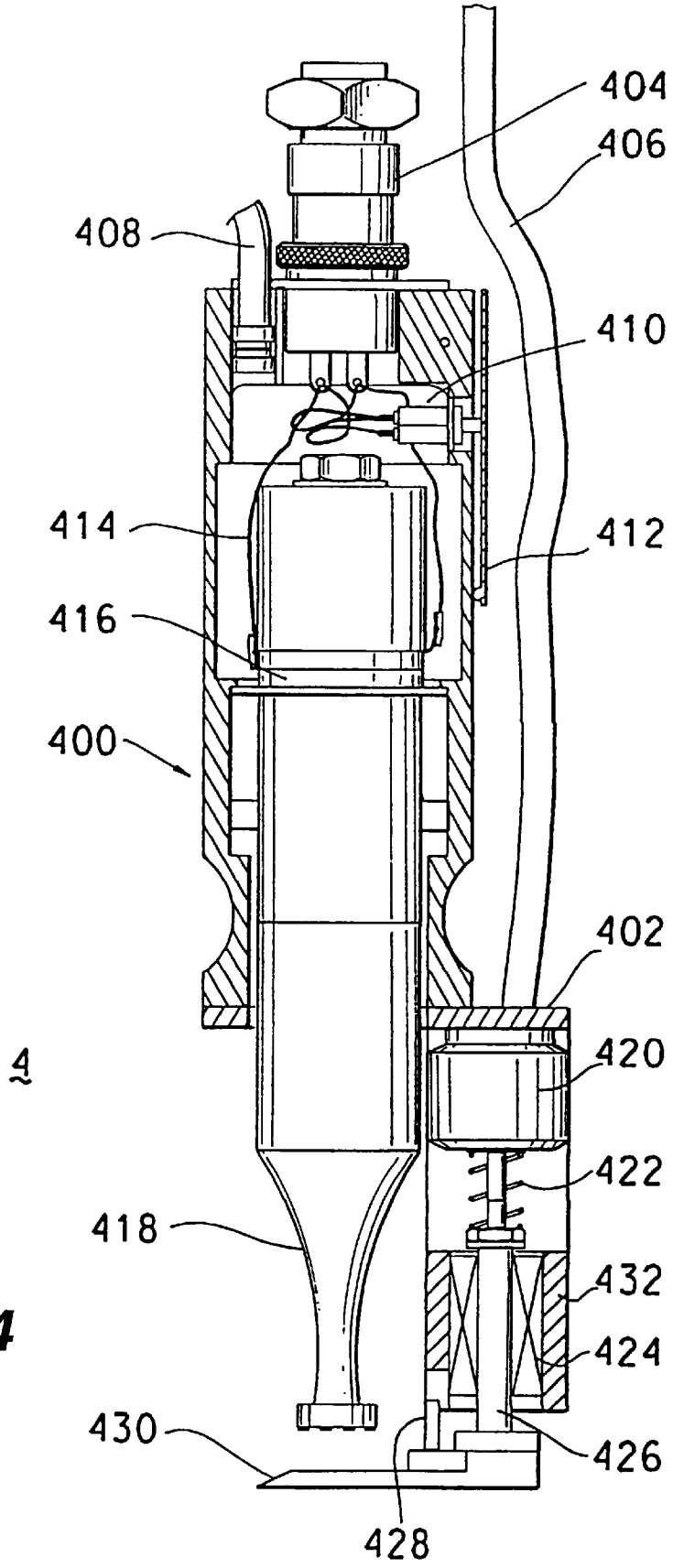
FIG. 4 shows the sectional view of a P.P. tape bonding apparatus.

The P.P. tape bonding apparatus 4 that implements the bonding operation as recited above is shown in FIG. 4 and includes an ultrasonic wave generation device and a movable lower mold set. The ultrasonic wave generation device includes a casing 400 having a channel therein and is open-ended. The channel of the casing 400 accommodates a cable connector 404, an ultrasonic wave resonator 416, a melting head 418, and a switch 410. The cable connector 404 engages the inner wall of one end of the channel through a thread connection. The ultrasonic wave resonator 416 also engages the inner wall of the channel through a thread connection. In addition, the ultrasonic wave resonator 416 engages the melting head 418 through a thread connection. A slit exists between the ultrasonic wave resonator 416 and inner wall of the channel which allows passage of the coolant air to cool off the ultrasonic wave resonator 416 and the melting head 418 during melting bonding operation. The coolant air piping 408 supplies the coolant air. The cable connector 404 allows connection of four wires in which two are the power line 414 and the ground line respectively. The other two lines are the control lines.

The movable lower mold set connects to the casing 400 through the connecting plate 402. The movable lower mold set includes a cylinder 420, a plunger 426, a spring 422, a bearing 424, an anti-rotation bar 428, a lower mold 430 and a casing 432. The pressurized air driving the plunger 426 comes from the air piping 406. The casing 400 facilitates an actuator 412 by which the operator selectively turns on the switch 410. The cylinder 420 drives the plunger 426 making the lower mold 430 press against the surface of the melting head 418. At the moment in which the lower mold 430 pressing against the surface of the melting head 418, the ultrasonic wave resonator 416 resonates and produces the ultrasonic wave. The overlapping portions of the P.P. tapes 20, 22 (not shown in FIG. 4) which are pressed together by the lower mold 430 and the surface of melting head 418 are therefore melted and bonded together. After the preset bonding period expires, the pressurized air is released and, due to the action of spring 422, the plunger 426 is driven such that the lower mold 430 separates from the melting head 418. This completes the melting bonding operation. It can be seen from FIG. 4, the teeth structures are provided over the surface of the melting head 418.

An anti-rotation bar 428 is vertically provided over the lower mold 430 and received within a corresponding slot on the casing 432. During bonding operation which involves the linear movement of the plunger 426, the anti-rotation bar 428 prevents the relative rotation of the lower mold 430 with respect to the melting head 418. Therefore, the lower mold 430 always aligns with the melting head 418 during melting bonding operation.

The invention has been described with reference to the drawings shown in figures and the preferred embodiment recited above. However, it is to be understood that above recitation is illustrative rather than limiting. Therefore, equivalent modifications and/or replacement are possible and still within the intended scope of protection of the invention defined by the following claims.

What is claimed is:

1. A carton packing, said carton defining a first direction and a second direction, the carton being wrapped by a first P.P. tape in the first direction, the carton being wrapped by a second P.P. tape in the second direction, the first P.P. tape intersecting with the second P.P. tape at respective overlapping portions, and the carton packing being characterized in that the first P.P. tape is bonded to the second P.P. tape at the overlapping portions of by an ultrasonic wave heating procedure to prevent the detachment of the first P.P. tape from the second P.P. tape without leaving destructive marks.

2. The carton package structure as recited in claim 1, wherein said first direction is along a length-wise direction of the carton and the second direction is a width-wise direction of the carton.

* * * * *